US007394912B2

(12) United States Patent
Whipple

(10) Patent No.: US 7,394,912 B2
(45) Date of Patent: Jul. 1, 2008

(54) AUDIO HEADBAND DEVICE

(76) Inventor: Kingsley A. Whipple, 2753 Braeburn La., Evergreen, CO (US) 80439

( * ) Notice: Subject to any disclaimer, the term of this patent is extended or adjusted under 35 U.S.C. 154(b) by 477 days.

(21) Appl. No.: 10/728,461

(22) Filed: Dec. 5, 2003

(65) Prior Publication Data

US 2005/0123151 A1 Jun. 9, 2005

(51) Int. Cl.
*H04R 25/00* (2006.01)
*H04R 1/02* (2006.01)

(52) U.S. Cl. ..... 381/376; 381/388

(58) Field of Classification Search ..... 381/301, 381/309, 311, 334, 375, 376, 379, 384, 388; 379/430; 439/37; 455/351; 2/172, 181, 2/195.8, 202, 209, 209.13, 209.3, 452, 906
See application file for complete search history.

(56) References Cited

U.S. PATENT DOCUMENTS 4,776,044 A * 10/1988 Makins ..... 2/209.13
4,864,619 A * 9/1989 Spates ..... 381/309
5,625,903 A * 5/1997 Schultz et al. ..... 2/209
6,319,015 B1 * 11/2001 Faunce ..... 439/37

* cited by examiner

*Primary Examiner*—Sinh Tran
*Assistant Examiner*—Brian Ensey
(74) *Attorney, Agent, or Firm*—John L. Isaac

(57) ABSTRACT

An elastic headband device with integrated audio system is disclosed. The device includes a stretchable cloth member sized and shaped for positioning about the head and ears of an individual wearer. The cloth member includes a central cavity throughout with first and second side portions and a rear portion. A pair of audio speaker elements are removably disposed within the central cavity of the cloth member at the first and second side portions thereof. A mechanism is also provided for adjusting the relative position of each audio speaker element within the central cavity at its respective side portion to position each element opposite an ear opening of an individual wearer. A central aperture is positioned at the cloth member rear portion for accessing the central cavity. Finally, a plurality of speaker wires are attached to the audio speaker elements within the cloth member central cavity and exit through the central aperture at the rear portion for connection to an audio generation system.

12 Claims, 3 Drawing Sheets

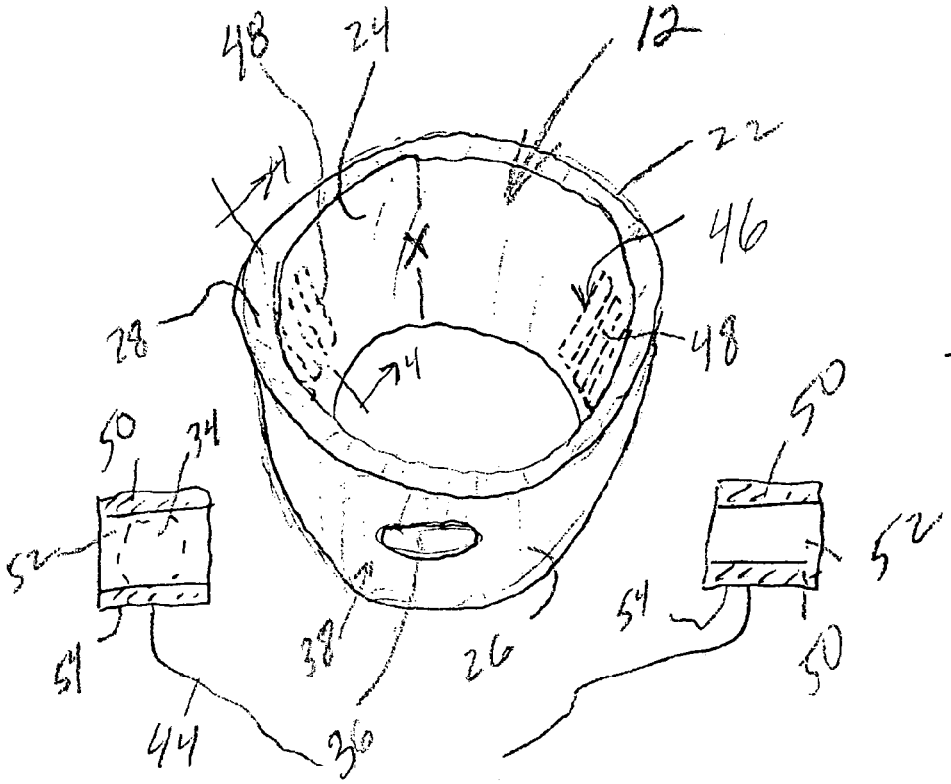
FIG. 3
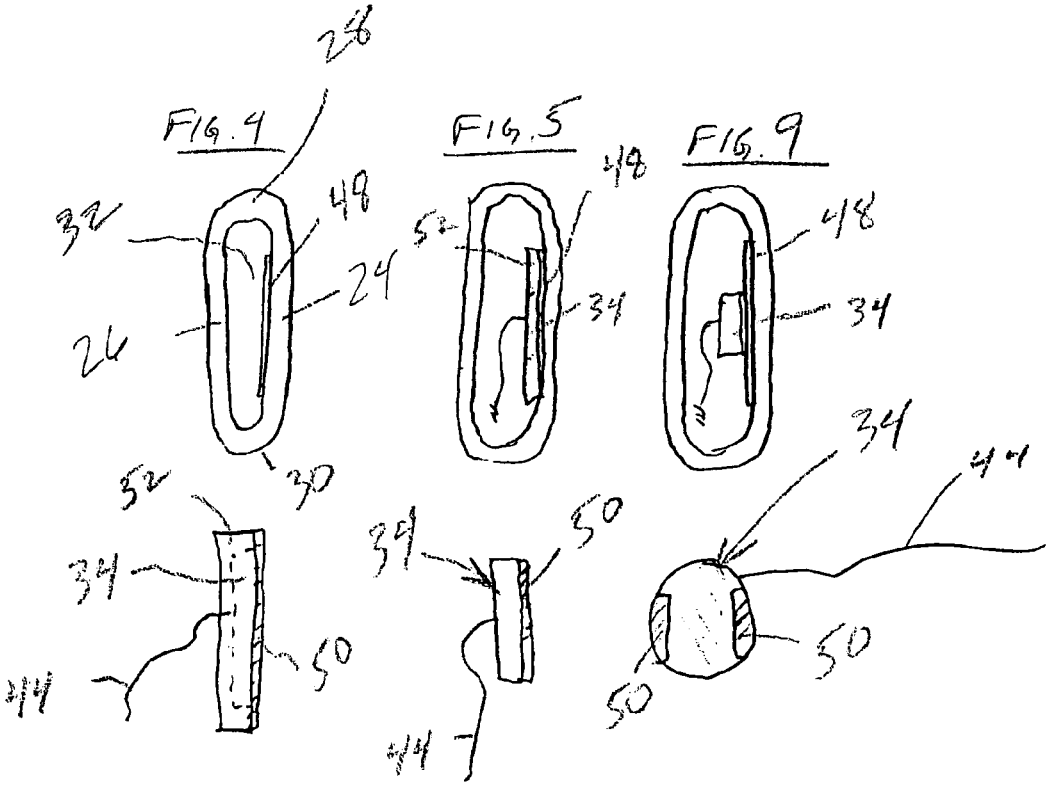

AUDIO HEADBAND DEVICE

BACKGROUND OF THE INVENTION

1. Field of the Invention

The present invention relates generally to ear protection devices and, more particularly, to such devices adapted for portable audio entertainment. Specifically, the present invention relates to an elastic headband device for sweat absorption and warmth protection which device also includes an integrated audio system.

2. Description of the Prior Art

There are many situations when it is desirable to provide audio output for personal entertainment or communication purposes to be worn on or carried near the body. Such personal and portable communication and entertainment products include, for example, cellular and portable telephones, radios, tape players, and audio portions of portable video systems and personal monitors. One common use of audio systems with earphones or headsets involves exercise and athletic events. It is quite common to see people running or exercising with headsets or earphones positioned in or covering their ears. Unfortunately, the earphones or headsets are subject to being dislodged as a result of the physical activity of the individual utilizing the same. Moreover, perspiration and inclement weather can affect the integrity of the speakers and audio system.

Examples of audio listening systems which may avoid the above difficulties include those embedded in or associated with clothing or other external objects. Examples of these types of devices are illustrated in a variety of references including U.S. Pat. Nos. 4,070,553, 4,485,276, 4,490,842, 4,589,134, 4,876,724 and 5,757,929. While such systems do provide personal audio entertainment or communication, unfortunately there is little or no privacy relating to the sounds emitted thereby. Moreover, clarity is compromised. Alternatively, such audio systems can be included in earphones directly secured to the head of the user or into some sort of helmet or headgear worn by the individual user. Examples of such devices are shown in U.S. Pat. Nos. 4,110,853, 4,424,880, 4,538,034, 5,459,290, 6,104,816, 6,301,367 and 6,546,264. Unfortunately, the headgear can be cumbersome, and the earphones can be easily dislodged.

As previously indicated, perspiration and inclement weather may affect the integrity of the speakers and audio system. To deal with one or more of these issues, several different approaches have been created. U.S. Pat. No. 4,858,248 discloses a typical ski hat adapted to hold earphones in the open folds thereof. U.S. Pat. No. 4,670,911 discloses ear protection cups that attach to a ski mask strap and which offer ear warmth protection as well as earphone attachment capability. U.S. design patent Nos. D284,080, and D310,907 both disclose designs for headband radios. Finally, U.S. Pat. Nos. 5,438,698 and 5,953,434 both disclose sweat bands which are designed to provide audio entertainment to the user thereof by vibration through the skull.

While the above references illustrate a variety of devices worn on our over the head and which incorporate audio entertainment systems therein, they all tend to be very use specific. Moreover, those devices designed to absorb sweat are not particularly audio efficient. Thus, there remains a need for a simple h ad apparel device which functions both as a sweat absorption member as well as an ear warming entity coupled with an audio entertainment system that is washable as well as will remain in place despite the activity and movement of the individual wearing the device. The present invention addresses and solves this particular problem in the art.

SUMMARY OF THE INVENTION

Accordingly, it is one object of the present invention to provide an ear protection device.

It is another object of the present invention to provide an audio entertainment device for wearing about the head of an individual.

Yet another object of the present invention is to provide an elastic headband device for sweat absorption coupled with warmth protection which device also includes an integrated audio system.

Still another object of the present invention is to provide such a headband device with an audio entertainment system that is removable and adjustable to ensure close and immediate proximity to the ear openings of the individual wearing the device.

To achieve the foregoing and other objects and in accordance with the purpose of the present invention, as embodied and broadly described herein, an elastic headband device with integrated audio system is disclosed. The device includes a stretchable cloth member sized and shaped for positioning about the head and ears of an individual wearer. The cloth member includes a central cavity throughout with first and second side portions and a rear portion. A pair of audio speaker elements are removably disposed within the central cavity of the cloth member at the first and second side portions thereof. A mechanism is also provided for adjusting the relative position of each audio speaker element within the central cavity at its respective side portion to position each element opposite an ear opening of an individual wearer. A central aperture is positioned at the cloth member rear portion for accessing the central cavity. Finally, a plurality of speaker wires are attached to the audio speaker elements within the cloth member central cavity and exit through the central aperture at the rear portion for connection to an audio generation system.

In one modification of the invention, the cloth member is in the form of a cloth material adapted to provide sweat absorption as well as warmth protection to the head and ears of an individual wearer. In another aspect of this invention, the cloth material includes an inner and an outer layer secured together to form the central cavity. In still another aspect, the audio speaker elements are disposed between the inner and outer layers of cloth in the cloth member.

In another modification of the invention, the adjustment mechanism is in the form of a pair of attachment elements for adjustably positioning the audio speaker elements in the central cavity opposite the ear openings of an individual wearer. In one form, the attachment elements are comprised of a pair of hook and loop members secured both to the cloth material and to the speaker elements for selectively positioning and securing the audio speaker elements in the cavity. In another form, the attachment elements are comprised of a plurality of snap lock members secured both to the cloth material and to the speaker elements for selectively positioning and securing the audio speaker elements in the cavity.

In yet another modification, the adjustment mechanism is in the form of a pair of pouch or sleeve members each adapted to selectively contain one audio speaker element, with each sleeve member being selectively positioned and secured in the cavity by one of the attachment elements. In one aspect of this embodiment, the sleeve elements are adjustably positioned within the cavity to enable placement of the audio speaker elements opposite the ear openings of any individual wearer.

In still another form of the invention, the audio speaker elements are removably secured within the cavity to enable adjustable positioning within the cavity as well as removal through the central aperture for washing of the cloth member.

In another modification of the invention, a combination headband and earphone device is disclosed. In this modification, a cloth headband is provided and is sized and shaped for placement around the head and over the ears of an individual. The headband includes first and second side portions for covering the individual's ears, a front portion for covering the forehead of the individual, and a rear portion. The headband has inner and outer layers which form a central cavity throughout the first and second side portions and the rear portion. A pair of audio speakers are removably disposed within the central cavity of the headband at the first and second side portions. Adjustment elements are disposed at the relative positions of each of the audio speakers within the central cavity at the respective side portions to adjustably position each speaker opposite an ear opening of an individual wearing the headband. A central opening is located at the headband rear portion for accessing the central cavity. Finally, a plurality of speaker wires are attached to the audio speakers within the headband central cavity and exit through the central opening at the headband rear portion for connection to an audio generation system carried by the individual wearing the headband.

Still another modification of the invention is in the form of an ear protection device adapted for housing an audio system. The device includes a cloth headband sized and shaped for positioning about the head and ears of an individual wearer. The cloth headband has sufficient elasticity to permit placement over a plurality of different size heads and includes first and second side portions for covering an individual's ears, a front portion for covering an individual's forehead, and a rear portion. A central cavity is defined within the headband side and rear portions, while a central aperture is positioned at the cloth headband rear portion for accessing the central cavity. Finally, a mechanism is provided for selectively attaching and adjustably positioning sound emitting elements in the central cavity at the side portions.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings:

FIG. 3 is a top perspective view of a device constructed in accordance with the present invention and illustrating a pair of selectively removable speaker elements positioned exterior to the device;

FIG. 4 is a cross sectional view taken substantially along line 4-4 of FIG. 3;

FIG. 5 is a cross sectional view similar to that of FIG. 4 but illustrating one embodiment of speaker elements in position within the headband device of the present invention;

FIG. 6 is a side elevation of the speaker embodiment illustrated in FIG. 5;

FIG. 7 is a side elevation of a second speaker embodiment for use with the device of the present invention;

FIG. 8 is a front plan view of the speaker device of FIG. 7;

FIG. 9 is a cross sectional view similar to that of FIG. 4 but illustrating the of speaker element embodiment of FIGS. 7 and 8 in position within the headband device of the present invention;

DETAILED DESCRIPTION OF THE EXEMPLARY EMBODIMENTS

Figure 1:
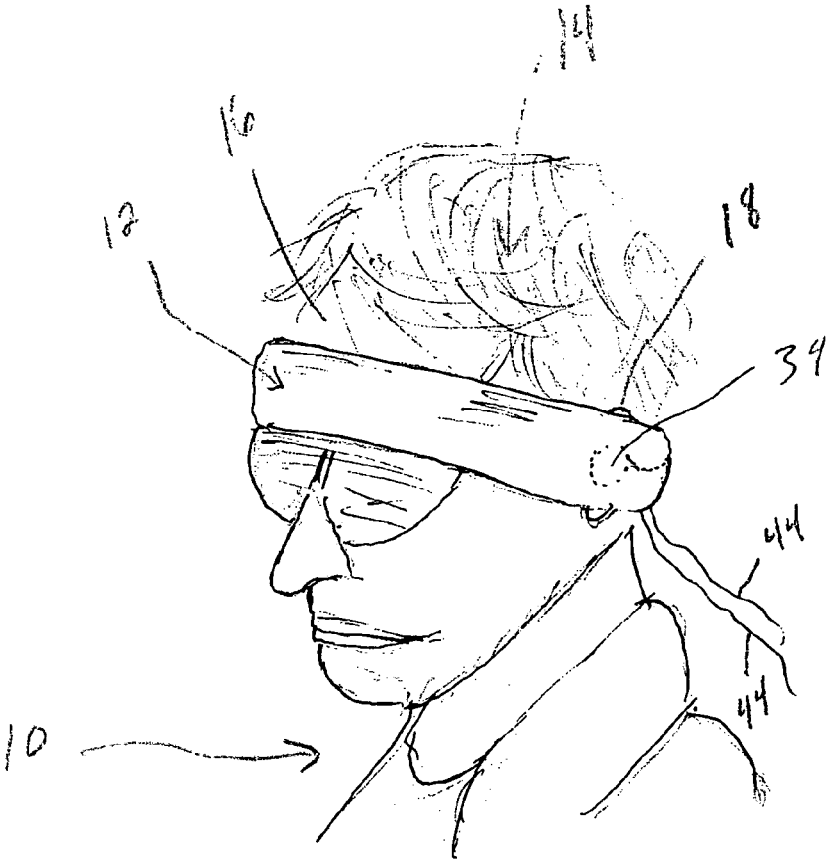
FIG. 1 is a front perspective of an individual wearing a device constructed in accordance with the present invention.
Figure 2:
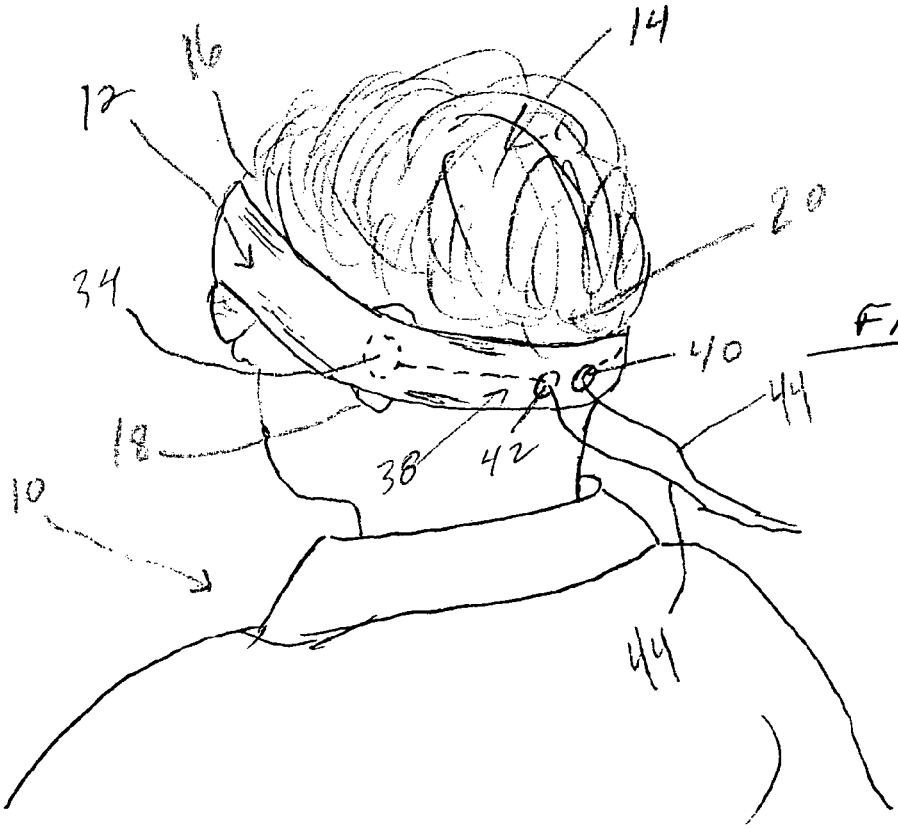
FIG. 2 is a rear perspective of an individual wearing a device constructed in accordance with the present invention.
Figure 10:
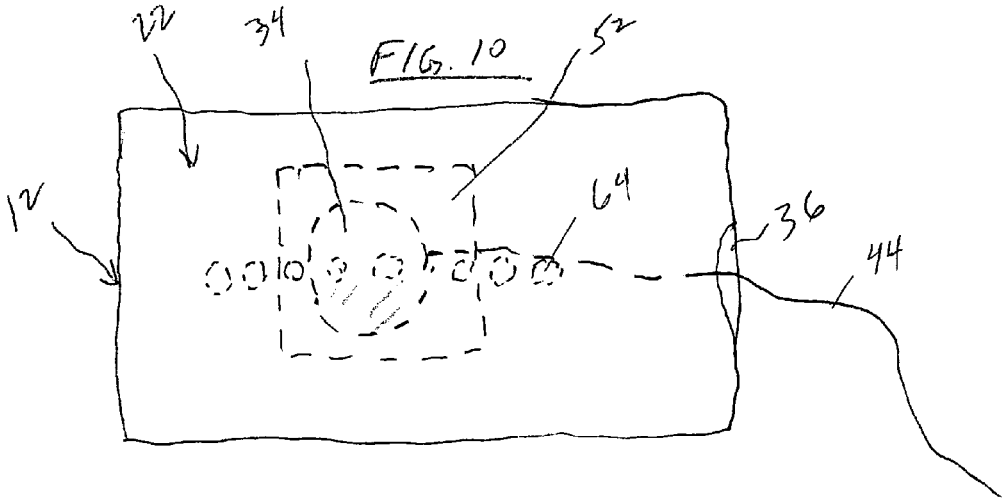
FIG. 10 is a side plan view of another embodiment of the present invention illustrating an alternate form of attaching the speaker elements within the device of the present invention.
Figure 11:
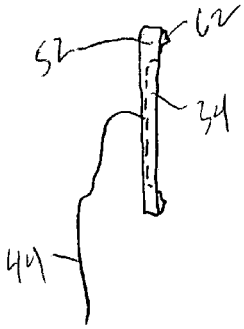
FIG. 11 is a side view of one speaker embodiment for attachment within the device illustrated in FIG. 10.
Figure 13:
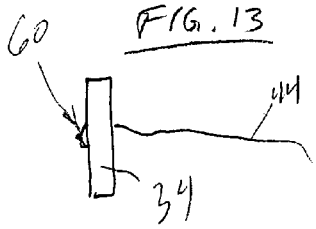
FIG. 13 is a side view of the speaker embodiment for attachment within the device illustrated in FIG. 12.
Figure 12:
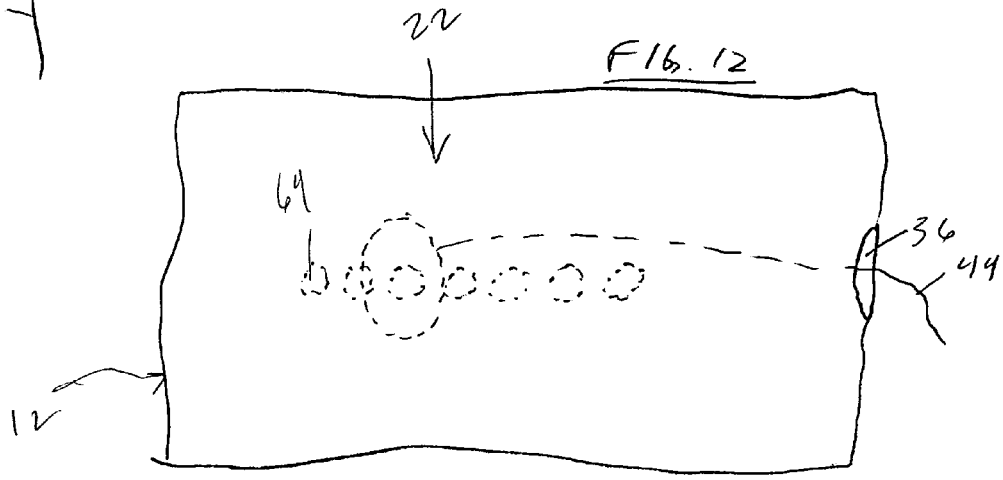
FIG. 12 is a side plan view of a similar embodiment of the present invention as shown in FIG. 10 but illustrating an alternate form of speaker element secured within the device of the present invention.

Referring first to FIGS. 1 and 2, an individual person 10 is illustrated having a headband 12 positioned about the head 14 of the individual 10. The headband 12 preferably covers the forehead 16 and both ears 18 of the individual 10. As can be seen from FIGS. 1 and 2, the headband 12 has sufficient elasticity to stretch about the forehead 16, the ears 18 and the rear 20 of the head 14 in such a manner as to be firmly maintained in place while covering virtually the entirety of both ears 18 without causing uncomfortable side pressure against the ears 18.

Referring now to FIGS. 1-9, the headband 12 is preferably in the form of a continuous circular or oval member 22 having a height "x" of preferably 1-2 inches, although any size dimension may be used so long as it effectively covers the ears 18. The member 22 is preferably made from a woven material such as cotton, wool, polyethylene, combinations thereof and the like. The material selection is designed to both absorb sweat when a wearer is exercising as well as to provide warmth when the wearer is in the out-of-doors exposed to a cold environment as when snow skiing. The member 22 may have any desired thickness and is preferably constructed having an inner layer 24, and outer layer 26, and top and bottom portions 28, 30 interconnecting the inner and outer layers 24, 26, respectively. This arrangement creates a central hollow cavity 32 which may extend throughout the entire structure of the member 22.

The central cavity 32 is sized and shaped to house and contain a pair of audio speaker elements 34. Access to the interior cavity 32 is preferably through a single opening 36 located at the rear portion 38 of the headband member 22. In an alternative embodiment, access to the interior cavity 32 is through a pair of openings 40, 42 also located at the rear portion 38. As described in greater detail below, the speaker elements 34 are positioned within the cavity 32 so as to be opposite the openings of the ears 18 of an individual 10 wearing the headband 12, as clearly illustrated in FIGS. 1 and 2. Since one primary function of the headband 12 is to absorb sweat, it must be washable. To provide this capability, the speaker elements 34 are removably secured within the cavity 32 at the appropriate locations. The means for removable attachment are described in more detail below. Movement of the speaker elements 34 into and out of the cavity 32 is afforded by the openings 36 or 40 and 42.

In addition to providing access to the cavity 32 by the speaker elements 34, the openings 36 and 40, 42, respectively, also provide a path for a pair of speaker wires 44 which interconnect the paired audio speaker elements 34 to an audio generation system of any known and desired type (not illustrated). Examples of such audio generation systems include tape players, CD players, radios and the like. Such audio generation systems are typically carried by the individual wearing the headband 12 in a pocket, backpack or other type of pouch or containment device, or on their belt.

Since the headband member 22 is preferably elastic or stretchable because of its woven nature, it is capable of fitting a variety of different head sizes. Consequently, due to different head sizes, shapes and ear placements found in the human population, the positioning of the speaker elements 34 within the cavity 32 must be variable. By permitting variable placement of the speaker elements 34 within the cavity 32, an individual user 10 can insure that the speaker elements 34 are directly opposite their ear openings for maximum audio clarity and volume control. To enable such variable placement, a mounting mechanism 46 is provided within the cavity 32.

In one preferred embodiment illustrated in FIGS. 3-9, a plurality of hook and loop fasteners (i.e., Velcro) 48, 50 are provided. By way of one example, strips of hook fasteners 50 may be positioned directly onto the speaker elements 34 or, alternatively, they may be placed onto a pouch or sleeve 52 into which the speaker elements 34 are placed. Likewise, a plurality of loop fasteners 48 are placed side by side on the inner surface of the member inner layer 24 within the cavity 32. In this manner, the speaker elements 34 or the pouches 52 containing the elements 34 may be positioned at a variety of locations within the cavity 32 and fixed at the desired position in accordance with the head geometry of a particular user 10. In this manner, the speaker element positions are adjustable, and once properly located may be firmly fixed so as not to move around within the cavity 32 as a result of movements and actions of the individual wearer 10.

As briefly discussed above, the speaker elements 34 may be directly attached to the inner layer 24 as illustrated in FIG. 9, or they may be placed within pouches or sleeves 52 which in turn are attached to the inner layer 24 as illustrated in FIG. 5. It should be noted that the speakers 34 or sleeves 52 may also be alternatively attached to the inner surface of the outer layer 26. In this at particular embodiment, the pouch 52 is in the form of a sleeve having one end opening 54 through which the speaker element 34 and its associated wire 44 may pass. In this manner, the sleeve 52 is attached to the inner layer 24 and provides additional protection for the speaker elements 34.

An alternative form of attachment of the speaker elements 34 and sleeves 52 is illustrated in FIGS. 10-13. In this particular embodiment, hook and loop fasteners are not utilized as the mounting mechanism 46. Alternatively, snap lock connectors 60 are utilized. In the illustrated embodiment, male connector elements 62 are positioned either directly onto the speaker elements 34 or onto the sleeves 52. Likewise, a plurality of female connector elements 64 are secured along the inner surface of the inner layer 24 for selective attachment to the male connectors 60. Consequently, as in the prior embodiment, the speaker elements 34 or sleeves 52 may be inserted through the opening 36 into the cavity 52. Once the proper location is determined, the male connectors 62 are attached to appropriate female connectors 64 to removably fix the positioning of the speaker element 34 or sleeve 52 within the cavity 32.

As can be seen from the above, the present invention provides a simple yet very effective mechanism for permitting an individual to wear a headband incorporating an audio entertainment system while pursuing a number of different physical activities such as exercising, jogging, snow skiing or the like. The headband provides a number of different functions including absorbing sweat when an individual perspires as well as moisture from the environment in which the individual may be located. In addition, the headband provides warmth and protection for the ears and ear openings when the individual wearing at the device is in a cold environment. The headband device of the present invention is capable of fitting a variety of head sizes while enabling accurate and fixed placement of the audio speakers to maximize clarity and volume. Moreover, the headband device of the present invention is readily washable since the speaker elements are easily removed therefrom and then reinserted and attached as desired.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. An elastic headband device with integrated audio system comprising:

a stretchable cloth member sized and shaped for positioning about the head and ears of an individual wearer, said cloth member having a central cavity throughout with first and second side portions and a rear portion;

a pair of audio speaker elements removably disposed within the central cavity of said cloth member at said first and second side portions;

a mechanism for adjusting the relative position of each said audio speaker element within said central cavity at its respective side portion to position each element opposite an ear opening of an individual wearer, said adjustment mechanism including a pair of attachment elements for adjustably positioning said audio speaker elements in said cavity opposite the ear openings of an individual wearer;

a pair of sleeve members each adapted to selectively contain one said audio speaker element, each said sleeve member being selectively positioned and secured in said cavity by one said attachment element;

a central aperture positioned at said cloth member rear portion accessing said central cavity; and a plurality of speaker wires attached to said audio speaker elements within said cloth member central cavity and exiting through said central aperture at said rear portion for connection to an audio generation system.

2. The headband device as claimed in claim 1, wherein said cloth member comprises material adapted to provide sweat absorption as well as warmth protection to the head and ears of an individual wearer.

3. The headband device as claimed in claim 2, wherein said cloth material comprises an inner and an outer layer secured together to form said central cavity.

4. The headband device as claimed in claim 3, wherein said audio speaker elements are disposed between said inner and outer layers of cloth.

5. The headband device as claimed in claim 1, wherein said attachment elements comprised a pair of hook and loop members secured to said cloth member and to said speaker elements for selectively positioning and securing said audio speaker elements in said cavity.

6. The headband device as claimed in claim 1, wherein said attachment elements comprised a plurality of snap lock members secured to said cloth member and to said speaker elements for selectively positioning and securing said audio speaker elements in said cavity.

7. The headband device as claimed in claim 1, wherein said sleeve elements are adjustably positioned within said cavity to enable placement of said audio speaker elements opposite the ear openings of an individual wearer.

8. The headband device as claimed in claim 1, wherein said audio speaker elements are removably secured within said cavity to enable adjustable positioning within said cavity as well as removal through said central aperture for washing of said cloth member.

9. A combination headband and earphone device comprising:

a cloth headband sized and shaped for placement around the head and over the ears of an individual and comprising material adapted to provide sweat absorption as well as warmth protection to the head and ears of an individual wearing said device, said headband including first and second side portions for covering the individual's ears, a front portion for covering the forehead of the individual and a rear portion, said headband having inner and outer layers forming a central cavity throughout said first and second side portions and said rear portion;

a pair of audio speakers removably disposed within the central cavity of said headband at said first and second side portions, said cloth material having an inner and an outer layer secured together to form said central cavity for housing said audio speakers;

adjustment elements disposed at the relative positions of each said audio speaker within said central cavity at said respective side portions to adjustably position each speaker opposite an ear opening of an individual wearing said headband, said adjustment elements comprising a plurality of attachment members at each said side portion within said cavity for adjustably and removably positioning said audio speakers in said cavity opposite the ear openings of any particular individual wearing the device;

a pair of sleeve members each adapted to selectively contain one said audio speaker, each said sleeve member being selectively secured in and adjustably positioned within said cavity by at least one said attachment element to enable placement of said audio speakers opposite the ear openings of any individual wearing said device;

a central opening located at said headband rear portion for accessing said central cavity; and a plurality of speaker wires attached to said audio speakers within said headband central cavity and exiting through said central opening at said rear portion for connection to an audio generation system carried by the individual wearing said headband.

10. The combination device as claimed in claim 9, wherein said attachment members are selected from the group consisting of hook and loop fasteners and snap lock connectors.

11. An elastic headband device having an integrated audio system, said device comprising:

an elastic, stretchable cloth member sized and shaped for positioning about the head and ears of an individual wearer and comprising washable material adapted to provide sweat absorption as well as warmth protection to the head and ears of an individual wearer, said elastic cloth member having an inner and an outer layer secured together to form a central cavity throughout with first and second side portions and a rear portion;

a pair of audio speaker elements removably disposed within the central cavity of said elastic, stretchable cloth member at a plurality of variably selective positions along said first and second side portions;

a pair of attachment elements for variably adjusting and selectively fixing the relative position of each said audio speaker element at a desired respective side portion within the central cavity of said elastic, stretchable cloth member opposite the ear openings of an individual wearer;

a pair of sleeve members each adapted to selectively contain one said audio speaker, each said sleeve member being selectively secured in and adjustably positioned within said cavity by at least one said attachment element to enable placement of said audio speakers opposite the ear openings of any individual wearing said device;

a central aperture positioned at said cloth member rear portion accessing said central cavity; and a plurality of speaker wires attached to said audio speaker elements within said cloth member central cavity and exiting through said central aperture at said rear portion for connection to an audio generation system.

12. The headband device as claimed in claim 11, wherein said attachment elements comprised a pair of hook and loop members secured to said cloth member within said cavity and to said speaker elements for selectively variably positioning and securing said audio speaker elements in said cavity.

* * * * *